United States Patent [10]

Caruel et al.

[11] 4,052,844

[45] Oct. 11, 1977

[54] GAS TURBINE COMBUSTION CHAMBERS

[75] Inventors: Jacques Emile Jules Caruel, Dammarie-les-Lys; Hervé Alain Quillévéré, Issy-les-Moulineaux; Philippe Marc Denis Gastebois, Melun, all of France

[73] Assignee: Societe Nationale d'Etude et de Construction de Moteurs d'Aviation, Paris, France

[21] Appl. No.: 583,189

[22] Filed: June 2, 1975

[51] Int. Cl.[2] ..... F02C 7/22

[52] U.S. Cl. ..... 60/39.65; 60/39.71; 60/39.74 R; 60/39.72 R; 431/10; 431/352

[58] Field of Search ..... 60/39.65, 39.71, 39.82 P, 60/39.06, 39.74 R, 39.72; 431/10, 351, 352

[56] References Cited

U.S. PATENT DOCUMENTS

| | | | |
|---|---|---|---|
| 2,577,918 | 12/1951 | Rowe | 60/39.65 |
| 2,616,257 | 11/1952 | Mock | 60/39.65 |
| 2,616,258 | 11/1952 | Mock | 60/39.65 |
| 2,720,081 | 10/1955 | Tutherly | 60/39.65 |
| 2,931,174 | 4/1960 | Allen | 60/39.82 P |
| 3,579,983 | 5/1971 | Caruel et al. | 60/39.71 |
| 3,589,127 | 6/1971 | Kenworthy et al. | 60/39.65 |
| 3,643,430 | 2/1972 | Emory et al. | 60/39.65 |
| 3,736,747 | 6/1973 | Warren | 60/39.65 |
| 3,872,664 | 5/1975 | Lohmann et al. | 60/39.65 |
| 3,879,939 | 4/1975 | Markowski | 60/39.65 |
| 3,934,409 | 1/1976 | Quillevere | 60/39.65 |

OTHER PUBLICATIONS

Yaffee, M. L., "NASA Seeks Clean Combustors", Aviation Wk. and Space Tech., Aug. 26, 1974, pp. 56–59.

*Primary Examiner*—Carlton R. Croyle
*Assistant Examiner*—Robert E. Garrett
*Attorney, Agent, or Firm*—William J. Daniel

[57] ABSTRACT

Combustion chamber comprising a first combustion zone opening into a wider second combustion zone into which the combustion air is admitted through a practically frontal air entry comprising obstacles which impart a coefficient of blocking of about 60% to 80% to it. The first zone is supplied with air and fuel in substantially stoichiometric proportion in idling. At the other running rates, a supplementary fuel flow is injected into the chamber and burns in the second zone in the wake of the obstacles.

17 Claims, 7 Drawing Figures

GAS TURBINE COMBUSTION CHAMBERS

BACKGROUND OF THE INVENTION

The present invention relates to combustion chambers of gas turbine engines and especially aviation gas turbine jet engines, and concerns more precisely a novel non-polluting combustion chamber arrangement.

In known combustion chambers, the fuel is injected into a primary combustion zone followed by a secondary combustion or dilution zone, the primary zone being arranged in such manner that the richness of the fuel-air mixture therein may be close to stoichiometric richness for the conditions of cruising flight (maximum continuous rate) and that its volume may be at least equal to the value which is necessary to ensure re-ignition in flight at a specific altitude. This conventional concept, from the pollution viewpoint, present the following drawbacks:

On idling, while the aircraft is stationary or taxying, by reason of the low means richness if the primary zone, the combustion efficiency is not very good, which involves a significant ejection of carbon monoxide and unburnt hydrocarbons in the vicinity of the ground.

On take-off (maximum rate) and cruising (maximum continuous rate), the combustion efficiency is close to the optimum, but the design of the chamber ensures a long stay of the gases in the zones where the mixture richness is substantially stoichiometric and where the temperature achieved is very high. The combination of this richness and the high values of the temperature and pressure at the entry of the chamber is favourable to the production of various oxides of nitrogen.

SUMMARY OF THE INVENTION

The purpose of the invention is the realisation of a combustion chamber which is free from these defects.

The combustion chamber according to the invention comprises:

A stepped flame tube placed in an air flow and defining a first combustion zone opening into a wider second combustion zone, with, between the two zones, a step forming a practically frontal air entry having a coefficient of blocking between about 60% and about 80% and preferably higher than about 70%; a device for injection of fuel into the first zone, of the type known as pre-vaporisation device or another analogous type ensuring the formation of re-circulation by entraining the combustions air upstream, means for supplying this injection device with fuel at an idling rate; combustion air entry apertures into the first zone which are dimensioned so that the combustion air forms a substantially stoichiometric mixture with the fuel at the idling rate, the first zone having a volume such that the combustion of this stoichiometric mixture is effect substantially in this first zone, and means permitting of injecting a supplementary flow of fuel into the flame tube in order to burn that fuel in the second zone, the volume of this second zone being such that it has an overall volume sufficient to ensure re-ignition in flight.

The richness of the air-fuel mixture formed in the first zone for idling operation of the gas turbine being stoichiometric, the chemical combustions reactions develop under much more favourable conditions than in a conventional combustion chamber in which for the same operation of the turbine this combustion is effected with an excess of air. In the combustion chamber according to the invention, the flow rates of carbon monoxide and unburnt hydrocarbons at the exhaust of the turbine, during idling operation of the turbine, are considerably reduced by reason of the fact that the first combustion zone is at optimum combustion efficiency.

The substantially frontal air entry formed by the step of the flame tube situated between the two zones has a coefficient of blocking between about 60% and about 80%, that is to say is interrupted by material obstacles occupying between about 60% and about 80% of the area of the step and consequently leaving between them air entry apertures which occupy between about 20% and about 40% of this area. The supplementary fuel flow at maximum and maximum continuous rates can be injected into the first zone, for example by increasing the fuel flow rate supplied to the injection device utilised in idling. A part of this fuel burns in the first zone forming hot gases which mix with the remainder of the fuel, and the mixture burns in the second zone, where a combustion of the pre-mixture type takes place in the wake of the material obstacles which act as flame stabiliser device.

It is also possible to inject at least a part of the supplementary fuel flow upstream of the obstacles into the air current passing through the substantially frontal air entry, by means of injection device of a type used in the after burner passages of gas turbine jet aviation engines, so as to mix at least partially with the air. The combustion of this part of the fuel and possibly of the part which is not burnt in the first zone is then of the partially premixed mixture type and occurs, here again, in the wake of the obstacles forming the flame stabiliser device.

In both cases, during operation at maximum and maximum continuous rates of the gas turbine, that is to say respectively at take-off and in cruising flight for an aircraft gas turbine jet engine, the combustion of the supplementary flow of fuel is thus effected in the second combustion zone where the hot and vaporised gases can continue to burn in a flow in which the re-circulations are of much smaller dimensions than in a conventional chamber, the stay of the gases in the second zone being likewise much shorter than in such a conventional combustion chamber.

The invention therefore permits a considerable reduction in the production of oxides of nitrogen at these maximum and maximum continuous operating rates.

It should be observed that the substantially frontal entry of air into the second combustion zone permits the elimination of passages of air through lateral walls of the flame tube which are normally needed in conventional combustion chambers but are harmful to the cooling by locally reducing the effectiveness of the "film cooling". Thus it is possible to constrict the cooling films, the effectiveness of which is not disturbed by the radial intakes. Moreover the absence of these radial intakes permits accumulation of the films in sufficient number to obtain the desired cooling.

The combustion chamber can be annular or cannular. The portion of the flame tube which defines the first chamber can form an annular envelope or several envelopes in cannular arrangement having an end pierced with apertures through which fuel admission tubes pass, and flanks pierced with apertures for the entry of combustion air, and supporting the pre-vaporisation devices or like injection devices. Each such envelope or preferably has a form elongated parallel with the air flow and the distance between the upstream end and the apertures pierced in the flanks is at least equal to half the width of the first combustion zone, so that the air entering radially through these apertures is sufficiently remote from the upstream end no to counteract the establishment of re-circulations.

As the first combustion zone of the combustion chamber according to the invention is appropriate to idling operation of the gas turbine and therefore of smaller dimensions than a conventional primary zone, the pre-vaporisation devices can consequently have a shorter length, which is favourable to their mechanical behaviour in the hot state.

The portion of the flame tube which defines the second combustion zone can form an annular envelope or several envelopes in cannular arrangement, and the width of each envelope is preferably at least equal to one and a half times the width of each envelope of the first combustion zone. The or each envelope defining the second combustion zone advantageously comprises at least two coaxial sleeves staggered towards the exterior in relation to one another from upstream to downstream, without perforations (that is to say without radial combustion air entry orifices) and kept spaced by struts pierced with passages for air for cooling by "film cooling".

This arrangement, which is favourable to the cooling of the combustion chamber, is combined with the design of the said chamber to permit the reduction of length thereof in comparison with conventional chambers in which the effectiveness of the "cooling films" disturbed by radial air intakes necessitates larger cooling areas.

In the combustion chamber according to the invention, the combustion air admitted frontally into the second zone can be introduced either through admission orifices formed in an annular wall forming the step of the flame tube between the downstream extremities of the enclosure of the first zone and the free edges of the sleeves of the second zone, or through passages included between radially directed arms extending between the enclosure and the sleeves, the step of the flame tube then being formed by these arms which leave the passage between them.

The radially directed arms advantageously have a re-curved U-shaped or V-shaped section, with the curvature or apex upstream. This arrangement forms a flame stabiliser device similar to thos which are currently used in after-burner passages. In the case where a part of the fuel, at "maximum" and "maximum continuous" rates, is injected into the second combustion zone, to this end it is possible to use a device comprising injection tubes placed in at least certain of the arms of U-section or V-section and pierced with orifices each situated behind a port formed in the curvature or apex of the arm, means for supplying the injection tubes with fuel in order to form fuel jets emitted in counter-current to the air flow through the ports, and substantiall components placed at a few millimeters upstream from the apices to form anvils receiving the impact of the jets and spreading these on either side into two transverse sheets, in accordance with an arrangement similar to that described in British Patent Application No. 17536/73.

BRIEF DESCRIPTION OF THE DRAWINGS

The invention will now be further described, by way of example, with reference to the accompanying drawings, in which:

DESCRIPTION OF PREFERRED EMBODIMENTS

Figure 1:
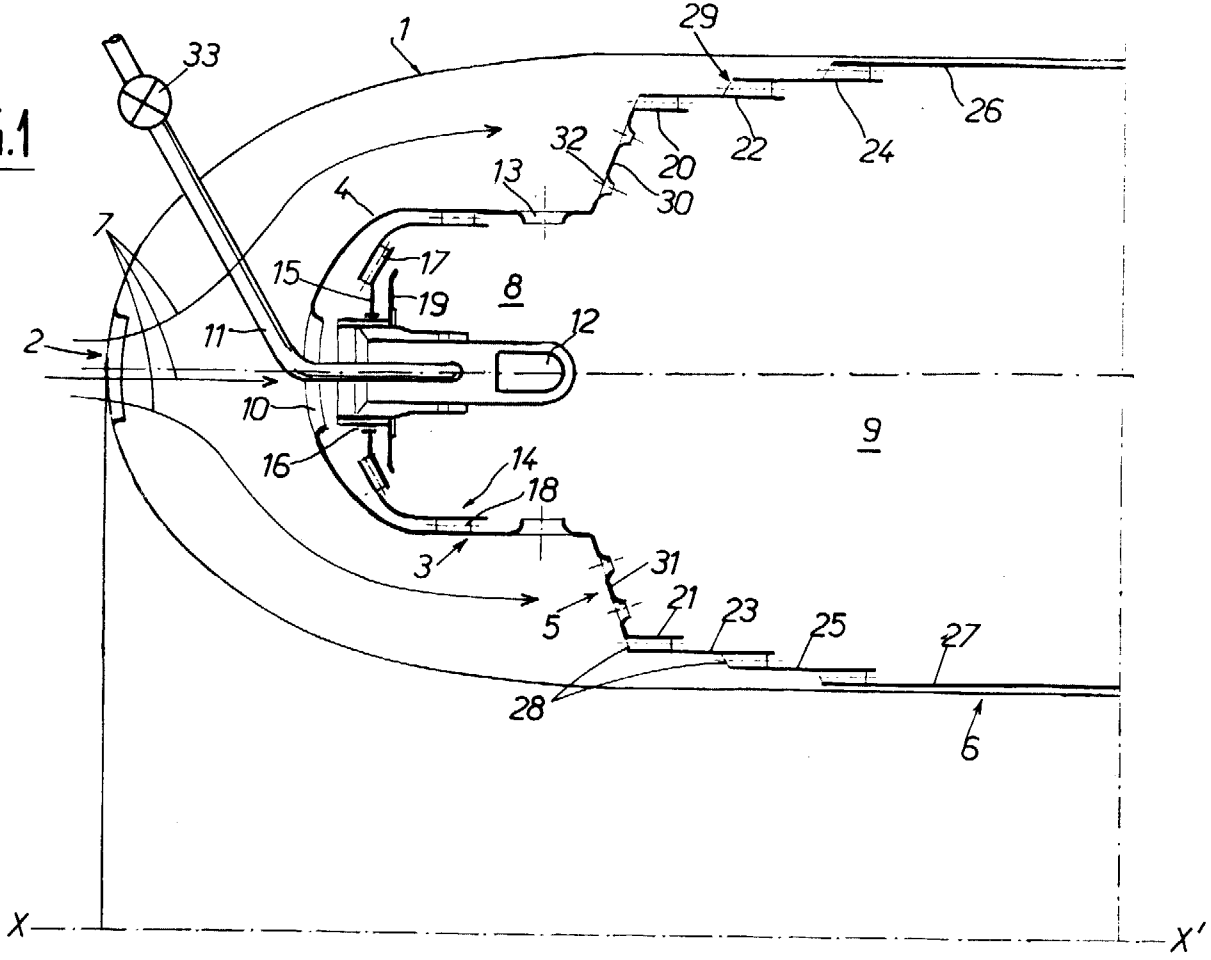
Figure 2:
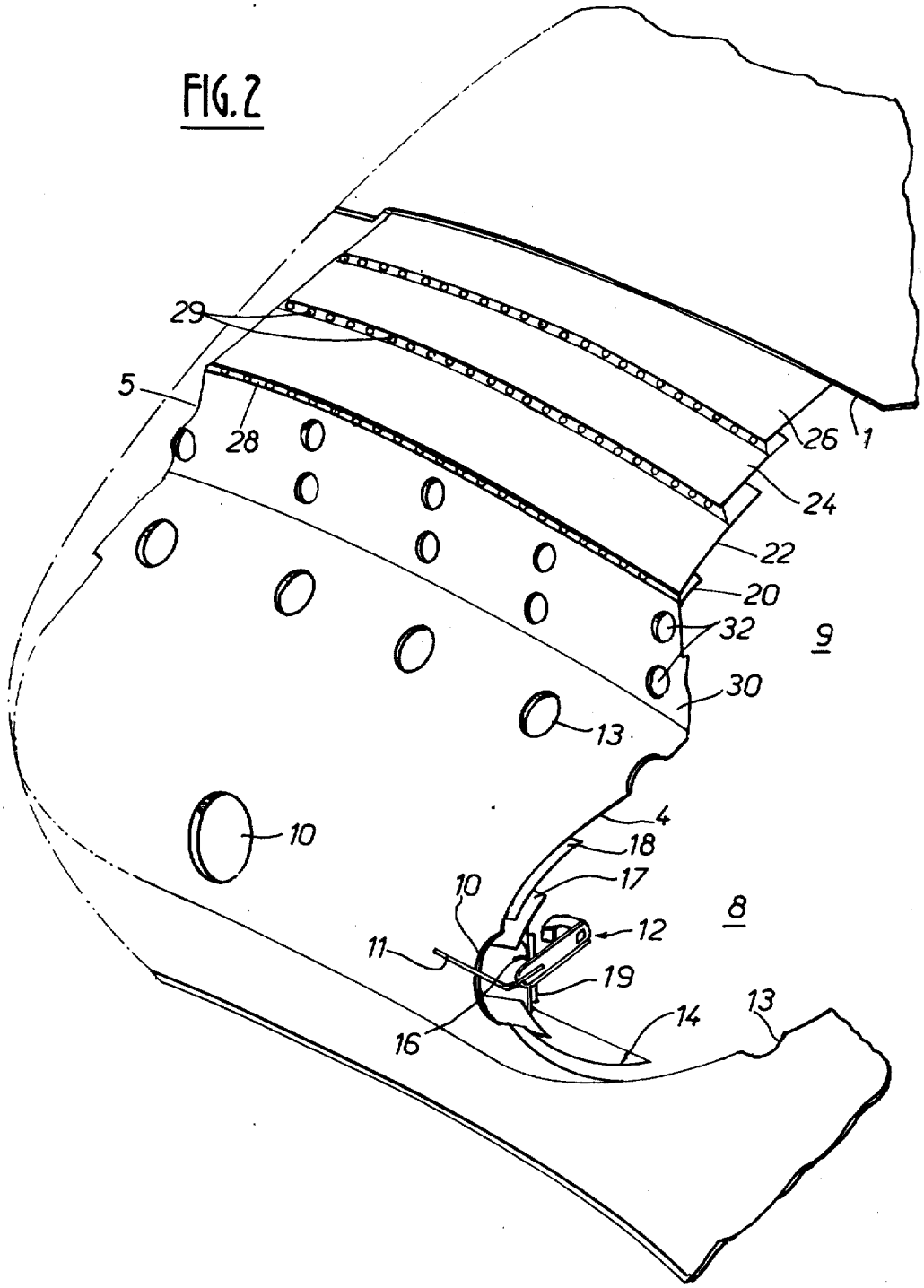
Figure 3:
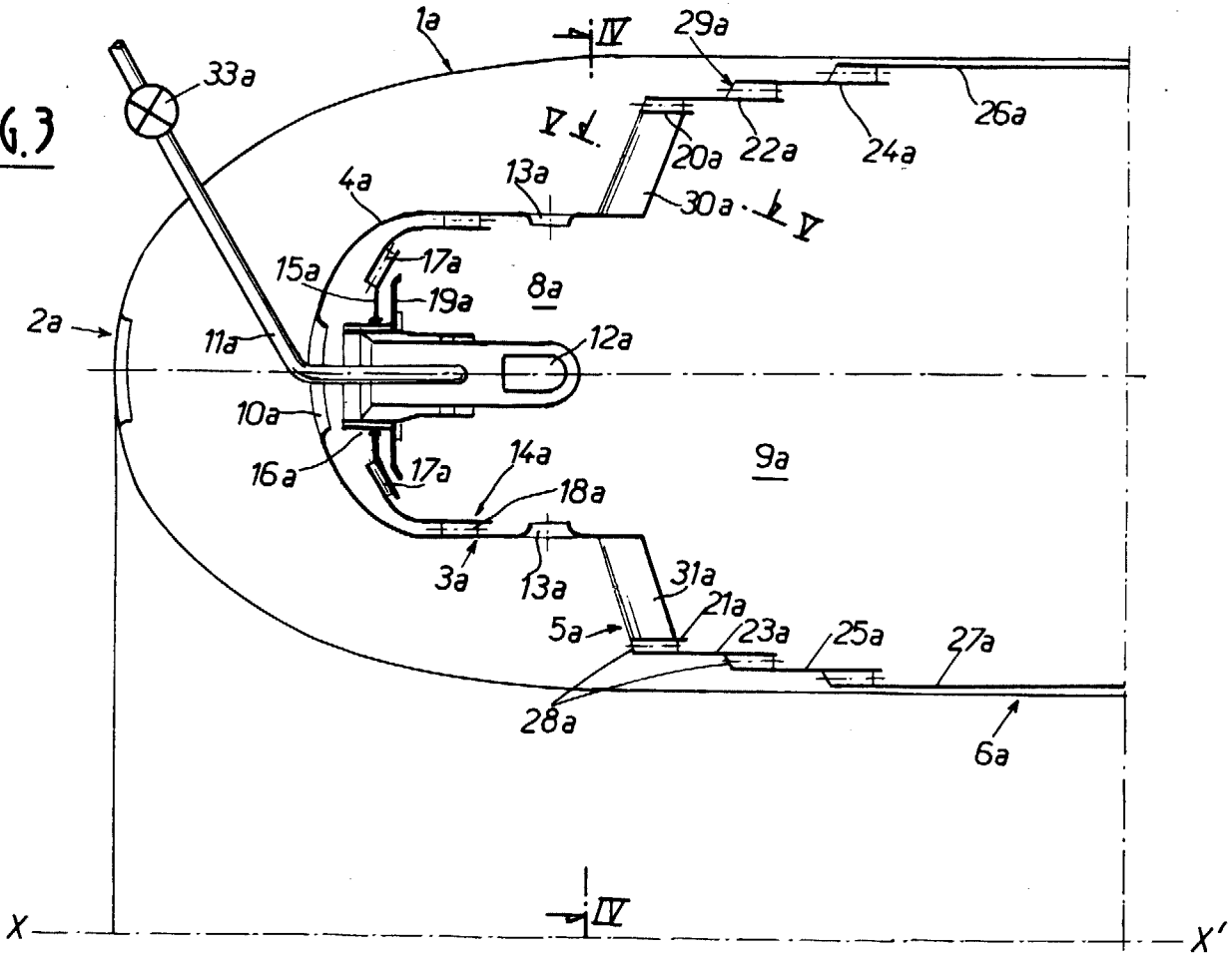
Figure 4:
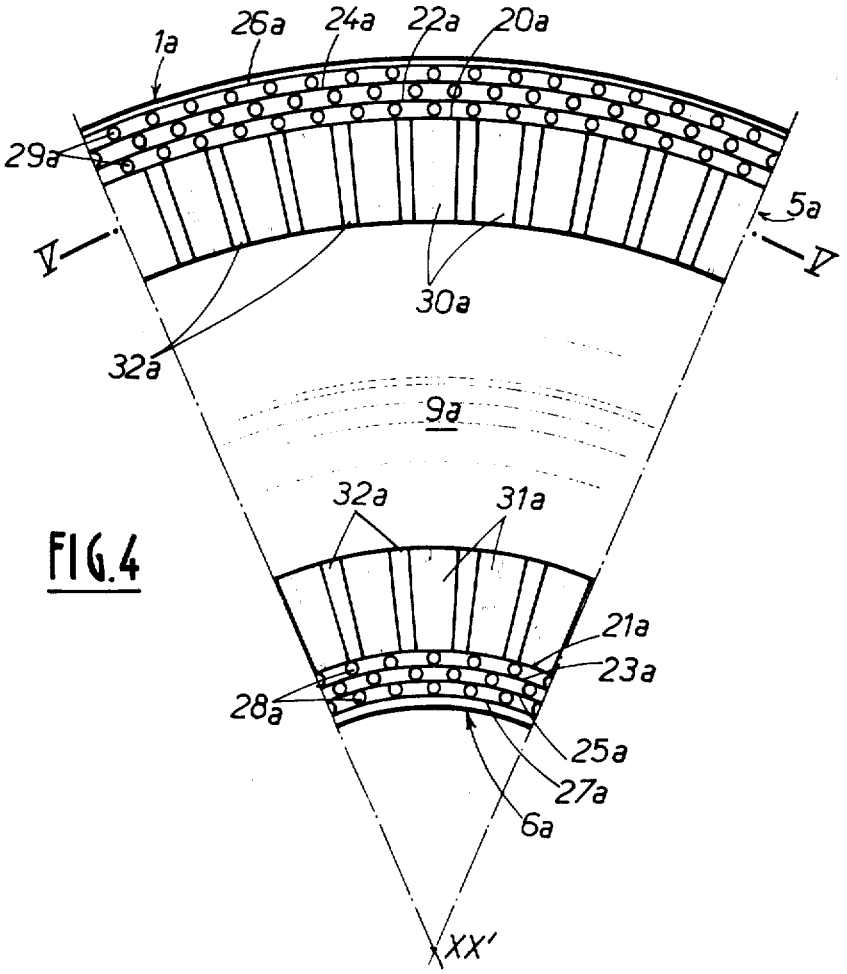
Figure 5:
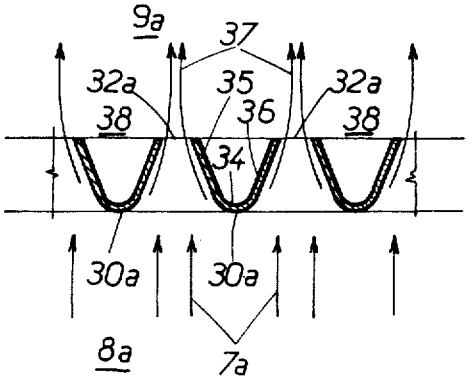
Figure 7:
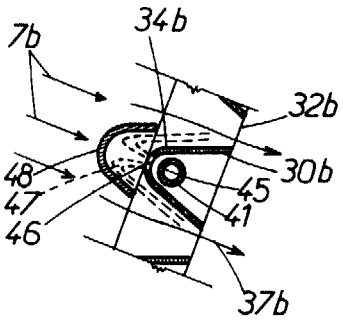
Figure 6:
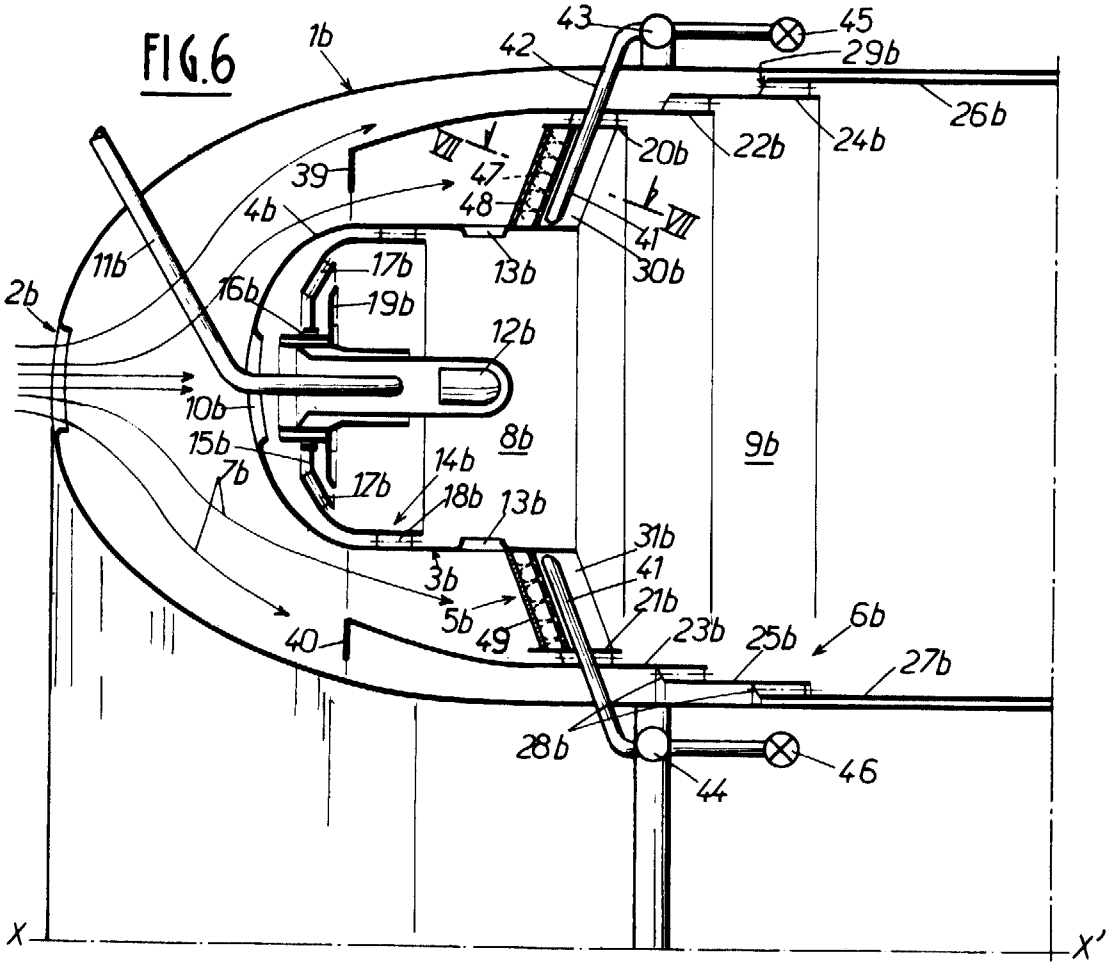

FIG. 1 is a half axial sectional view of an annular combustion chamber according to a first embodiment of the invention;

FIG. 2 is a fragmentary perspective view, partly broken away and partly in section, of the combustion chamber according to FIG. 1;

FIG. 3 is a view analogous with FIG. 1 showing a combustion chamber according to a second embodiment of the invention;

FIG. 4 is a fragmentary sectional view along the line IV—IV in FIG. 3;

FIG. 5 is a fragmentary sectional view along the line V—V in FIGS. 3 and 4;

FIG. 6 is a view analogous with FIG. 3 showing a third embodiment of the invention; and FIG. 7 is a fragmentary view analogous with FIG. 5, in section along the line VII—VII in FIG. 6.

In FIGS. 1 and 2 there is shown the upstream part of a combustion chamber forming part of a gas turbine jet aviation engine, which is not represented as a whole. The combustion chamber is contained in an annular casing 1 with axis X-X', provided upstream with an air inlet 2 connected by means (not shown) with the delivery side of the high pressure compressor (not shown) of the gas turbine jet engine, and the downstream part of which (not shown) is connected to the high pressure turbine (not shown) of the gas turbine jet engine. As is known, the air delivered by the compressor into the combustion chamber is used to cause a fuel to burn therein in order to produce hot gases which expand into high and low pressure turbines before forming a jet which effects the propulsion of the aircraft equipped with the gas turbine jet engine.

In the annular casing 1 there is placed an annular flame tube 3 comprising an upstream portion 4 connected by a step 5 to a wider downstream portion 6. Thus the flame tube 3 is placed in an airflow 7 indicated diagrammatically by arrows, which enters the casing 1 through the air inlet 2. The upstream portions 4 defines a first combustion zone 8 and the downstream portion 6 defines a second combustion zone 9.

The upstream end of the upstream portion 4 is pierced with apertures 10 through which fuel inlet tubes 11 and a part of the airflow 7 penetrate to supply fuel and primary air to pre-vaporisation devices or compartments 12 of the type described especially in U.S. Pat. Nos. 3,579,983 and 3,626,444.

The upstream portion 4 of the flame tube is likewise provided with perforations 13 permitting another part of the airflow 7 to penetrate radially into the first combustion zone 8 in order to supply the combustion air to it. Inside the upstream portion 4 there is fixed an annular wall 14 of which the upsteam portion forms a substantially flat end 15 pierced with a plurality of bores 16 in each of which there is fixed one of the pre-vaporisation devices 12 in the manner as described especially in British Pat. No. 1,397,296.

The wall 14 is pierced laterally with orifices 17, 18 for the admission of film cooling air for the cooling of the flame tube. The wall 14 is protected by a thermal screen 19 in the vicinity of each of the pre-vaporisation compartments 12.

The downstream portion 6 is formed by four pairs of coaxial sleeves 20–21, 22–23, 24–25, and 26–27, each pair of sleeves being staggered outwards in relation to the pair of sleeves situated immediately upstream thereof. The sleeves are held spaced by struts 28 pierced with air entry orifices 29 (see FIG. 2) and form a film cooling device similar to that described in U.S. Pat. No. 3,811,276. However, in this patent the cooling air films flowing along the internal surfaces of the sleeves are distrubed by apertures passing through the sleeves and through which the combustion air flows radially, while the embodiment as described here the first three pairs of sleeves 20–21, 22–23 and 24–25 are imperforate and the sleeves 26–27 of the last pair are pierced only by dilution air intake apertures (not shown) situated far downstream in the downstream part (also not shown) of the combustion chamber, that is to say in a region where the temperature of the combustion chamber is already greatly reduced.

The step 5 of the flame tube is formed by two rings 30, 31 connected to the upstream portion 4 and connected respectively to the two sleeves 20, 21 of the first pair of sleeves of the downstream portion 6 of the flame tube. Each of the rings 30, 31 is of very open frusto-conical form, that is to say having an apex half angle close to 90° (approximately 70° in the embodiment represented) and is pierced by a plurality of air inlet orifices 32 occupying less than 30% of its area. The step 5 thus forms, in relation to the air flow 7, a substantially frontal air entry into the second combustion zone 9, having a coefficient of blocking greater than 70%.

The tubes 11 are supplied with fuel by a device 33 permitting of regulating the fuel flow rate and indicated diagrammatically by a cock. The device 33 permits especially to control, at will, the fuel flow rate to an idling flow rate, a flow rate for maximum continuous engine rate and a flow rate for maximum engine rate. The device 33 is shown diagrammatically as a cock, but may comprise any conventional control means of an aircraft, for example, three different fuel flow meters corresponding respectively to the respective flow rates, and means operable by the pilot to connect selectively the output of the desired flow meter to inlet tubes 11. The apertures 10 and 13 are dimensioned so that the air which they permit to enter the first combustion zone 8 during idling forms, with the fuel injected at the idling flow rate into this zone through the re-vaporisation devices 12, a stoichiometric mixture which is ignited by an ignition device (not shown). As explained in U.S. Pat. Nos. 3,579,983, 3,626,444 and British Pat. No. 1,393,296 mentioned above, the pre-mixture devices 12 inject jets of a mixture of fuel and air admitted through the apertures 10 towards the upstream side. The jet entrain towards the upstream side the major part of the combustion air entering radially through the apertures 13, so that whirling re-circulation zones form about the compartments 12 facilitating stabilisation and maintenance of the combustion of the stoichiometric mixture.

The first combustion zone 8 has a volume such that the combustion of the stoichiometric mixture is effected completely in this first zone 8, so that only hot burnt gases penetrate into the second zone 9, which gases mix with the air admitted through the orifices 32. The axial distance between the plane of the substantially flat end 15 (which forms the end of the first combustion zone) and the axes of the combustion air inlet apertures 13 is slightly greater than the radius of the upstream portion 3 of the flame tube; the combustion air entering radially through the apertures 13 is thus sufficiently remote from the end not to counteract the establishment of re-circulations.

In order to cause the gas turbine jet engines to operate at the maximum countinuous rate or at the maximum rate, the regulating device 33 is opened further in order to admit a supplementary flow of fuel into the pre-vaporisation compartments 12. This supplementary fuel flow cannot burn in the first combustion zone 8, and forms with the hot burnt gases a mixture which is entrained into the second combustion zone 9, wherein it burns in contact with the combustion air admitted through the orifices 32. The combustion is of the pre-mixing type and is effected in the wake of the solid parts of the rings 30 and 31, which act as a flame stabiliser device. Combustion of the pre-mixture type is analogous with that which occurs in a conventional after-burner passage, with the difference however that the flame stabiliser device of an after-burner passage has a relatively low coefficient of blocking (of the order of 35 to 50%), so that in an after-burner passage the axial length of the combustion zone is very great. The coefficient of blocking is here greater (a little above 70%) because the length of the combustion chamber is limited. However the coefficient of blocking of the air inlet 5 is clearly less than that (higher than 90%) of the air inlets of conventional combustion chambers where it is sought to retain fuel in the re-circulation zones for a long time. By virtue of this compromise, the stay of the gases in the hotter regions of the second combustion zone is sufficiently short so as to very appreciably to reduce the production of oxides of nitrogen.

The embodiment according to FIGS. 3 to 5, where the elements which are similar to FIG. 1 are designated by the same reference numerals with the suffix *a*, differs from the embodiment which has just been described only in the form of the frontal air entry to the step **5*a* of the flame tube 3*a*. This step 5*a* is here formed by two series of radially disposed arms 30*a* and 31*a* connected to the upstream portion 4*a* and connected respectively to the two sleeves 20*a*. 21*a* of the downstream portion 6*a* of the flame tube. As is seen from FIGS. 4 and 5, these arms leave air inlet passages 32*a* between them which occupy in total about 30% of the area of the step 5*a*. Thus the step 5*a* forms a substantially frontal air inlet having a coefficient of blocking of about 70%. Each of these arms is formed by a strip of sheet metal curved into a very open U-form which is concave towards the downstream side, that is to say the re-curved portion 34 is disposed towards the upstream side and the two arms 35, 36 extend downstream. In the embodiment represented the arms 35, 36** form an angle of the order of 70° between them.

In operation, a part of the air flow **7*a* sweeps into the passages 32*a* and in the downstream portion 9*a* of the combustion chamber forms thin jets 37 of combustion air (see FIG. 5) separated by the wakes 38 of the arms. The mixture of fuel and hot gas coming from the upstream portion 8*a* of the combustion chamber burns in these wakes 38 in contact with the combustion air 37** and in the shelter of the arms which act as a flame stabiliser device. It should be noted that, although the arrangement as represented appears particularly advantageous so that the arms may act as a flame stabiliser device, in other forms of embodiment the angle of divergence of the arms could be less pronounced.

The embodiment according to FIGS. 6 and 7, in which the elements similar to the previous figures are designated by the same references with the suffice *b*, differs from the embodiment according to FIGS. 3 to 5 in that means are provided to inject a supplementary flow of fuel into the second combustion zone 9b at the maximum continuous rate and at the maximum rate. Moreover the two sleeves 22b, 23b of the second pair of sleeves extend upstream of the step 5b and comprise flanges 39, 40 at their upstream ends to separate the parts of the airflow 7b which form respectively the combustion air and the cooling film air of the downstream portion 6b of the flame tube.

The injection of fuel into the second combustion zone 9b is effected by mans of a plurality of rectilinear injectors 41 disposed radially in a certain number of arms 30b (see FIG. 7) and supplied with fuel through tubes 42 which issue from circular manifolds 43, 44 which are themselves supplied by flow regulating devices 45, 46. The injectors 41 are pierced with orifices 45 each situated behind a port 46 formed in the re-curved portion 34b in such manner as to eject fuel jets 47 upstream through the ports 46 when the injectors are supplied with fuel, which jets 47 strike the arms 48 and 49 placed parallel with the arms 30b and 31b respectively and at a few millimeters upstream. In the embodiment represented, the arms 48 are formed by strips of sheet metal curved into the form of troughs with their concavity downstream. The arms 48 act as anvils which transversely project the jets 47 into the combustion air thin jets 37b. As explained in British Pat. Application No. 17536/73 mentioned above, this arrangement accelerates the mixture of the fuel with the combustion air and ensures the cooling of the arms 30b and 31b, thus avoiding the risk of self-ignition of the fuel upstream of these arms.

What is claimed is:

1. A combustion chamber comprising:

a. a stepped flame tube placed in an air stream and comprising:

1. an upstream section bounding a first combustion zone extending parallel to the air stream,
2. a downstream section wider than the upstream section and bounding a second combustion zone extending parallel to the air stream, said downstream section having an upstream portion which extends over a major length thereof and has imperforate generally annular walls and passages therebetween for the entry of cooling air flowing film-like along said inperforate walls, and
3. shoulder means extending outwardly of the first combustion zone and generally transversely of the air stream direction, to form a step between said upstream and downstream tube sections, said step having a multiplicity of air intake apertures therethrough to admit into said second combustion zone a flow of air taken from said air stream and flowing substantially parallel thereto, and solid portions between said intake apertures to produce wakes in said flow of air, b. fuel injection means in the first combustion zone for emitting jets of fuel towards the upstream end of said first combustion zone, c. means for supplying the injection means with fuel at an idling flow rate, d. air inlet means for feeding the first combustions zone with combustion air, said air inlet means comprising means for directing air from the air stream substantially parallel thereto along said upstream tube section, and a plurality of openings through said flame tube, adjacent the downstream end of said upstream section, for introducing air from the air stream substantially radially into the first combustion zone, whereby the combustion air is entrained by said jets of fuel and recirculated in said first combustion zone, said air inlet means being so dimensioned that the combustion air forms a substantially stoichiometric mixture with the fuel at said idling flow rate, the first combustion zone having such a volume that combustion of the stoichiometric mixture takes place within the first combustion zone, and e. means for injecting a supplementary flow of fuel in said flame tube upstream of said second combustion zone to cause combustion of said supplementary flow of fuel in said wakes behind the said portions of said shoulder means, the volume of said second combustion zone being such that the combustion chamber has an overall volume sufficient to ensure re-ignition in flight.

2. A combustion chamber as claimed in claim 1, wherein said solid portions occupy between about 60% and about 80% of the area of said step.

3. A combustion chamber as claimed in claim 2, wherein said solid portions occupy more than 70% of the area of said step.

4. A combustion chamber according to claim 1, wherein the injection means is of the pre-vaporisation type.

5. A combustion chamber according to claim 1, comprising means for injecting the supplementary flow of fuel into the first combustion zone in order to cause a combustion of the premixed mixture type in the second combustion zone.

6. A combustion chamber according to claim 1, comprising means for supplying said injection means with at least a portion of the supplementary fuel flow.

7. A combustion chamber according to claim 1, comprising means for injecting at least a part of the supplementary fuel flow upstream of said air intake apertures in said shoulder means in order to cause a combustion of the partially premixed mixture type in the second combustion zone.

8. A combustion chamber according to claim 1, wherein said shoulder means comprise at least one annular wall of the flame tube and said air intake apertures comprise a plurality of orifices through the annular wall.

9. A combustion chamber according to claim 1, wherein said shoulder means comprise a plurality of radially directed arms and said air intake apertures comprise passages between the arms.

10. A combustion chamber according to claim 9, wherein the arms have a recurved section forming a portion curved towards the upstream side and two arms extending downstream.

11. A combustion chamber according to claim 10, wherein the arms are divergent.

12. A combustion chamber according to claim 10, comprising means for injecting at least a part of the supplementary fuel flow in the form of jets directed upsteam through ports of the said curved portions, and a plurality of members placed a few millimeters upstream of the ports to form anvils in order to receive the impact of the jets and spread the jets transversely on either side of the said members.

13. A combustion chamber according to claim 12, wherein the said members are of trough form.

14. A combustion chamber according to claim 1, wherein the stepped flame tube comprises an upstream portion defining the first combustion zone upstream of the shoulder means and a downstream portion defining the second combustion zone downstream of the shoulder means, the upstream portion having an upstream end plate pierced with apertures to supply the injection device with air, fuel inlet tubes passing into the apertures to supply the injection device with fuel, and lateral walls pierced with said openings in order to supply the first combustion zone with combustion air.

15. A combustion chamber according to claim 14, wherein the lateral walls have a form elongated parallel with the air flow and the distance between the upstream end plate and said openings is at least equal to the radial dimension of said upstream portion.

16. A combustion chamber according to claim 1, wherein the stepped flame tube comprises an upstream portion defining the first combustion zone upstream of the shoulder means and a downstream portion defining the second combustion zone downstream of the shoulder means, the downstream portion having a height of at least approximately one and a half times the radial dimension of the upstream portion.

17. A combustion chamber according to claim 1, wherein the stepped flame tube comprises an upstream portion defining the first combustion zone upstream of the shoulder means and a downstream portion defining the second combustion zone downstream of the shoulder means, the downstream portion comprising at least two coaxial imperforate sleeves staggered outwards in relation to one another from upstream to downstream, struts keeping the said sleeve spaced apart and a plurality of air passages through the struts for the cooling of the sleeves with films of cooling air between adjacent pairs of such sleeves.

* * * * *